US006833663B2

(12) United States Patent
Tanaka et al.

(10) Patent No.: US 6,833,663 B2
(45) Date of Patent: Dec. 21, 2004

(54) FLUORESCENT MATERIAL LAYER WITH METAL BACK, METHOD OF FORMING THE FLUORESCENT MATERIAL LAYER, AND IMAGE DISPLAY DEVICE

(75) Inventors: Hajime Tanaka, Gunma-ken (JP); Tomoko Nakazawa, Gunma-ken (JP); Takeo Ito, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 22 days.

(21) Appl. No.: 10/415,105

(22) PCT Filed: Oct. 31, 2001

(86) PCT No.: PCT/JP01/09532

§ 371 (c)(1),
(2), (4) Date: Apr. 30, 2003

(87) PCT Pub. No.: WO02/37522

PCT Pub. Date: May 10, 2002

(65) Prior Publication Data

US 2004/0121183 A1 Jun. 24, 2004

(30) Foreign Application Priority Data

Oct. 31, 2000 (JP) ..... 2000-333365

(51) Int. Cl.[7] ..... H01J 29/10

(52) U.S. Cl. ..... 313/473; 313/461; 313/466

(58) Field of Search ..... 313/461, 466, 313/473

(56) References Cited

FOREIGN PATENT DOCUMENTS

| | | |
|---|---|---|
| JP | 58-97237 | 6/1983 |
| JP | 64-30134 | 2/1989 |
| JP | 64-77845 | 3/1989 |
| JP | 5-190084 | 7/1993 |
| JP | 9-283063 | 10/1997 |
| JP | 11-339683 | 12/1999 |
| JP | 2000-208044 | 7/2000 |
| JP | 2000-243271 | 9/2000 |

*Primary Examiner*—Vip Patel
(74) *Attorney, Agent, or Firm*—Oblon, Spivak, McClelland, Maier & Neustadt, P.C.

(57) ABSTRACT

A phosphor screen with metal back of the present invention has a degree of adhesion of 30% or more in the ratio of the contact area of a phosphor layer (2) and a metal back layer (3). The deterioration (film burning) of emission brightness in FED can be suppressed and the brightness characteristics can be improved. The film thickness of the metal back layer is set to 50 to 100 nm and the light transmittance thereof is set to 10% or less to provide a highly bright display with excellent reflectivity. The phosphor screen with metal back can be formed by transferring a metal film onto the phosphor layer formed on the internal surface of a translucent substrate by using a transfer film.

10 Claims, 5 Drawing Sheets

FLUORESCENT MATERIAL LAYER WITH METAL BACK, METHOD OF FORMING THE FLUORESCENT MATERIAL LAYER, AND IMAGE DISPLAY DEVICE

TECHNICAL FIELD

The present invention relates to a phosphor screen with metal back, a forming method thereof and an image display device having the phosphor screen with metal back.

BACKGROUND ART

Conventionally, a face plate of a cathode-ray tube (CRT) or an image display device of a field emission type (FED) has a metal back layer of aluminum (Al) or the like formed on a phosphor layer, which is disposed on the internal surface of a translucent panel, by a method such as vacuum deposition. The metal back layer reflects light advancing in a direction of an electron source, which is in the light emitted from the fluorescent material (phosphor layer) by electrons emitted from the electron source, to the panel side to enhance brightness and also serves to stabilize the potential of the phosphor layer. It also has a function to prevent the phosphor layer from being damaged by ions generated by ionization of residual gas in a vacuum envelope.

Generally, the FED has a lower electron beam acceleration voltage of 500 V to 10 kV than that of the CRT and a higher current value than that of the CRT, to make the fluorescent material to emit light. Therefore, there was a phenomenon referred to as so-called film deterioration that emission brightness of the phosphor layer is lowered substantially by the continuation of the electron beam irradiation.

One of the causes of the deterioration of such emission brightness is considered to be the accumulation of electric charges generated by the electron beam irradiation in the phosphor layer. And, it is known as shown in FIG. 8 for example that brightness can be improved by forming a metal back layer of aluminum on the phosphor layer as compared with the case without the metal back layer. And, an effect of suppressing the deterioration of emission brightness by such a metal back layer is substantially not variable depending on the thickness of the aluminum film. Electron beam irradiation conditions in FIG. 8 are to perform spot fixed continual irradiation to a phosphor layer at an anode voltage of 6 kV and a cathode current of 150 $\mu$A/cm$^2$ and measure brightness in a degree of vacuum of $10^{-5}$ Pa.

A conventional metal back layer, however, does not have a sufficient effect of suppressing the deterioration of emission brightness, and brightness is lowered because an electron beam is partly absorbed by the metal back layer. Thus, a phosphor screen which maintains high brightness for a long time could not be realized.

The present invention has been completed to remedy the above problems, and an object of the invention is to provide a phosphor screen with metal back which substantially suppresses the deterioration of emission brightness of the phosphor layer, a method for forming it, and an image display device which has the phosphor screen with metal back improved in the brightness and can make display of high brightness.

DISCLOSURE OF THE INVENTION

A first aspect of the present invention is a phosphor screen with metal back as described in claim 1, which comprises a phosphor layer formed on the internal surface of a translucent substrate and a metal back layer formed on the phosphor layer, wherein a degree of adhesion of the metal back layer to the phosphor layer is 30% or more in a ratio of areas of the layers contacted with each other.

As described in claim 2, the phosphor screen with metal back of the present invention can have the metal back layer with a thickness of 5 to 100 nm, and the light transmittance of 10% or less. And, as described in claim 3, the metal back layer can have an intervening layer containing inorganic particles on at least one main surface thereof.

A second aspect of the present invention is a method for forming a phosphor screen with metal back as described in claim 4, which comprises preparing a translucent substrate, forming a phosphor layer on the internal surface of the translucent substrate, forming a metal back layer, the forming of the metal back layer including disposing a transfer film having a base film and at least a parting agent layer and a metal layer stacked on the base film so that the metal layer is contacted to the phosphor layer with an adhesive agent layer between them, transferring the metal layer by pressing and bonding, and peeling the base film, and heating the substrate which has the metal back layer formed on the phosphor layer, wherein the metal layer is transferred in such a way that a degree of adhesion between the phosphor layer and the metal layer is 30% or more in a ratio of areas of both the layers contacted.

As described in claim 5, the method for forming the phosphor screen with metal back according to the present invention can have a step of forming an intervening layer containing inorganic particles on the phosphor layer before disposing the transfer film on the phosphor layer in the step of forming the metal back layer. As described in claim 6, the method for forming a phosphor screen with metal back can further comprise forming an intervening layer containing inorganic particles on the metal back layer formed on the phosphor layer after heating the substrate.

A third aspect of the present invention is an image display device as described in claim 7 and the image display device has a face plate, wherein the phosphor screen with metal back as set forth in claim 1 is disposed on the face plate. And, as described in claim 8, this image display device can comprise a rear plate being disposed opposite to the face plate and have many electron-emitting elements on the rear plate.

In the phosphor screen with metal back according to the present invention, a degree of adhesion between the metal back layer and the phosphor layer is increased to 30% or more in the ratio of areas of both the layers contacted to each other as compared with prior art, so that the deterioration of emission brightness of the phosphor layer is suppressed substantially. To form such a phosphor screen with metal back having a high degree of adhesion between the metal back layer and the phosphor layer, the metal back layer having a very low light transmittance, namely high reflectivity, can be obtained by adopting the transfer method, and an image display device capable of making highly bright and high-definition display can be obtained.

BEST MODE FOR IMPLEMENTING THE INVENTION

The relationship between a degree of adhesion between a metal back layer and a phosphor layer of the phosphor screen with metal back and the deterioration (film deterioration) of emission brightness of the phosphor layer and the light transmittance (reflectivity) of the metal back layer was tested in detail as described below.

Figure 1A:
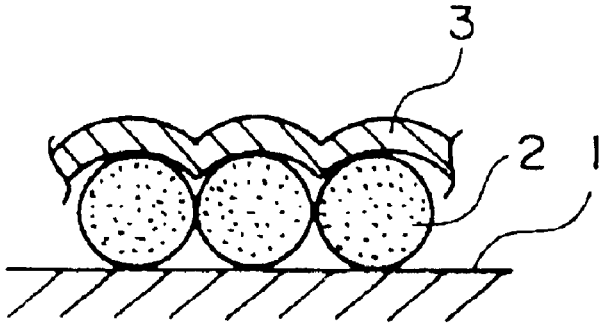
FIG. 1A to FIG. 1C are enlarged sectional diagrams of phosphor screens with metal back obtained by a transfer method.
Figure 1B:
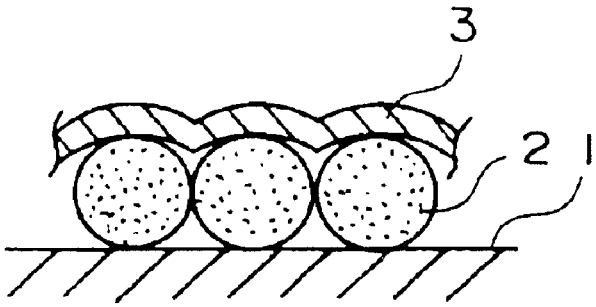
Figure 1C:
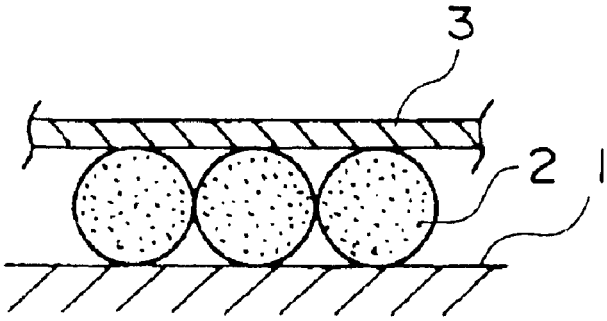
Figure 2A:
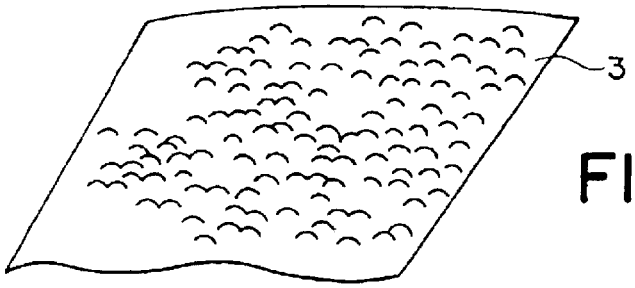
FIG. 2A to FIG. 2C are perspective diagrams schematically showing surfaces of metal back layers of the phosphor screens with metal back shown in FIG. 1A to FIG. 1C.
Figure 2B:
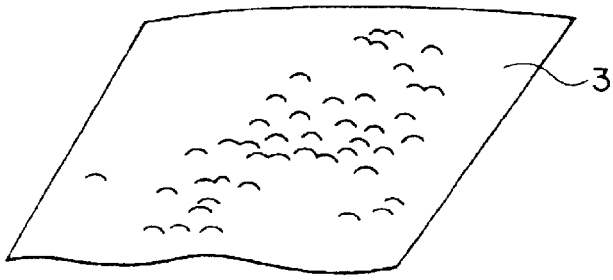
Figure 2C:
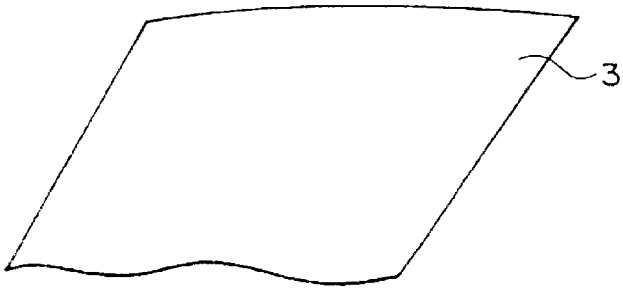

First, the relationship between the degree of adhesion and the brightness deterioration was examined as follows. Specifically, three types of aluminum metal back layers (a), (b) and (c) having different states of adhesion with a phosphor layer were formed, by the transfer method, on a phosphor layer produced by a known method. Enlarged sectional diagrams of the obtained phosphor screens with metal back are shown in FIG. 1A to FIG. 1C. And, the surface states of the metal back layers of the phosphor screens with metal back shown in FIG. 1A to FIG. 1C are schematically shown in FIG. 2A to FIG. 2C.

It was assumed that the ratio of an area of the metal back layer in contact with the phosphor layer to the entire surface area was a degree of adhesion. And, the degree of adhesion was calculated on the basis of an SEM photograph showing the surface state of the metal back layer. It was found that the degree of adhesion of the metal back layer (a) shown in FIG. 1A and FIG. 2A was 70 to 100%, the degree of adhesion of the metal back layer (b) shown in FIG. 1B and FIG. 2B was 30 to 69%, and the degree of adhesion of the metal back layer (c) shown in FIG. 1C and FIG. 2C was less than 30%. In the drawings, reference numeral 1 denotes a translucent substrate such as a glass panel, 2 denotes a phosphor particle, and 3 denotes an aluminum metal back layer.

Figure 3:
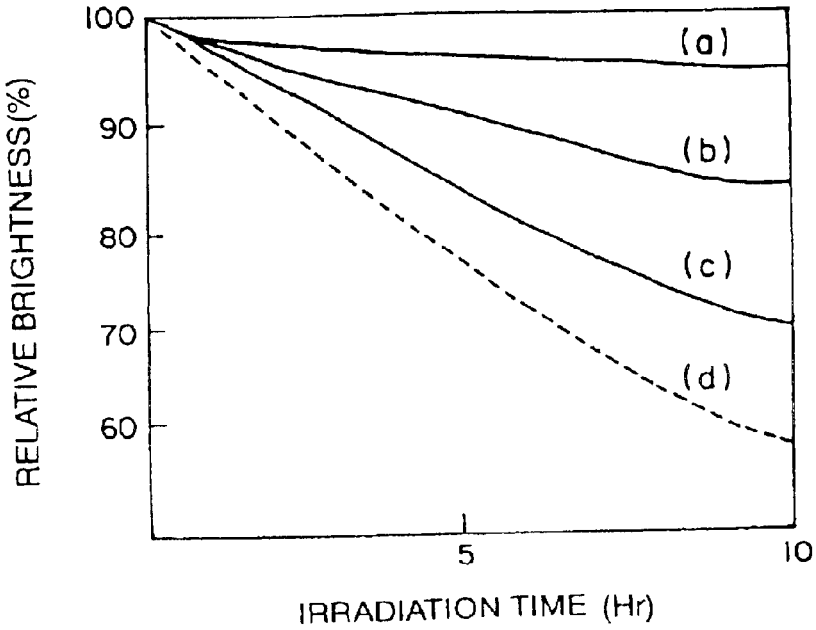
FIG. 3 is a graph showing a relationship between an electron beam irradiation time and a post-irradiation brightness retention rate (relative brightness) of a phosphor screen with metal back.

Then, these phosphor screens with metal back and the phosphor screen without a metal back layer and having an ITO film for conduction formed between the glass panel and the phosphor layer were examined for brightness deterioration characteristics. To examine the brightness deterioration characteristics, center brightness was measured with an acceleration voltage of 10 kV, a current density of 0.25 $\mu A/mm^2$ and an overall raster signal. And, a relationship between the electron beam irradiation time and a brightness retention rate (relative brightness) after the irradiation was determined. The determined result is shown in FIG. 3. The measured results of the phosphor screens with metal back having the metal back layers (a), (b) and (c) are indicated by (a), (b) and (c), and the measured result of the phosphor screen without the metal back layer is indicated by (d).

It is seen from the graphs that even when the same phosphor layer and metal back layer are used, the deterioration of brightness can be improved substantially by enhancing the degree of adhesion between the metal back layer and the phosphor layer. The reason for that is considered that as the degree of adhesion between the phosphor layer and the metal back layer is higher, electric charges generated in the phosphor layer by the electron beam irradiation have a tendency to escape outside via the metal back layer and are hardly accumulated in the phosphor layer.

Then, a relationship between the degree of adhesion of the phosphor screen with metal back and the light transmittance (or reflectivity) of the metal back layer was examined in connection with the method for forming the metal back layer.

By the three methods, namely the transfer method, the lacquer method and the emulsion method, the metal back layer (a) having a degree of adhesion of 70 to 100%, the metal back layer (b) having a degree of adhesion of 30 to 69% and the metal back layer (c) having a degree of adhesion of less than 30% were formed. Then, the metal back layers formed on the phosphor layer by the three methods were measured for the light transmittance. The measured results are shown in Table 1 and FIG. 4. For evaluation of the light transmittance in Table 1, ◎ indicates the light transmittance of 10% or less, ○ indicates 11 to 30%, Δ indicates 31 to 40%, and X indicates 40% or more.

TABLE 1

| | (a) Degree of adhesion 70 to 100% | (b) Degree of adhesion 30 to 69% | (c) Degree of adhesion less than 30% |
|---|---|---|---|
| Transfer method | ◎ | ◎ | ◎ |
| Lacquer method | X | Δ | ○ |
| Emulsion method | X | Δ | ○ |

The phosphor screen with metal back having a high degree of adhesion can be formed by the above methods as the follows.

Specifically, when the metal back layer is formed by the transfer method, the degree of adhesion between the metal back layer and the phosphor layer can be increased by enhancing flexibility of the entire transfer film by adjusting a base film thickness or the like. The degree of adhesion can also be adjusted by controlling rubber hardness, a heating temperature, a pushing force and the like of a rubber roller for contact bonding under heating used for transferring. By lowering the rubber hardness of the rubber roller for contact bonding under heating to a level lower than the ordinary hardness, the rubber roller can be more intimately contacted to the base film surface of the transfer film to improve the degree of adhesion between the metal back layer and the phosphor layer. Besides, by increasing the rubber roller's heating temperature and/or pressing force, the rubber roller can be more intimately contacted to the base film surface of the transfer film to improve the degree of adhesion.

When the metal back layer is formed by the lacquer method, a water layer is formed thin on the phosphor layer (a rewet amount is decreased) to make a lacquer agent such as nitrocellulose formed on it easy to penetrate into the gaps of the phosphor layer. Thus, the degree of adhesion between the metal back layer and the phosphor layer can be improved. And, it is also possible to enhance the degree of adhesion of the metal back layer by making the thickness of the lacquer film thin.

When the phosphor screen with metal back is formed by the emulsion method, the degree of adhesion between the phosphor layer and the metal back layer can be increased by lowering a temperature of the phosphor layer at the time of application of an emulsion or by easing the heating conditions.

Figure 4:
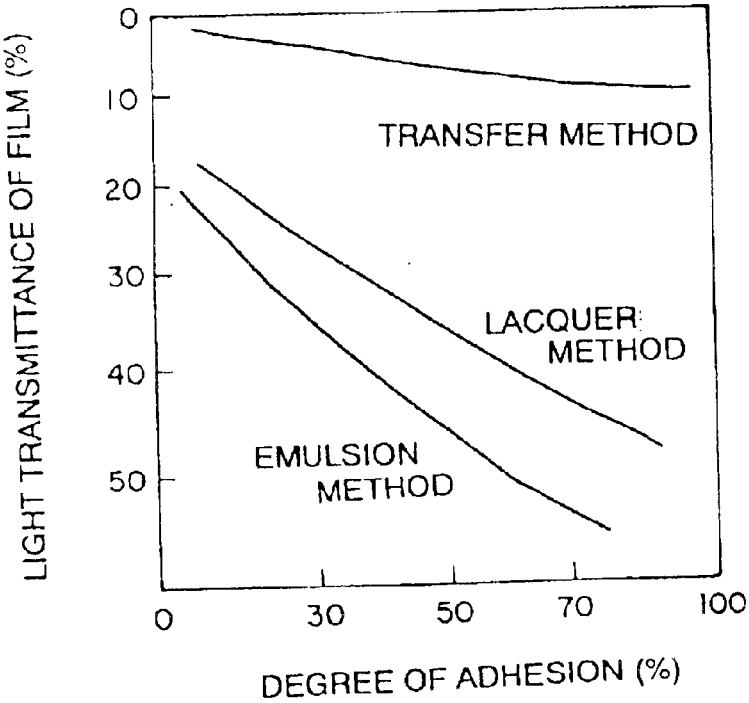
FIG. 4 is a graph showing a relationship between a degree of adhesion and the light transmittance of the metal back layers formed on a phosphor layer by a transfer method, a lacquer method and an emulsion method.

The following is seen from Table 1 and FIG. 4. When the metal back layer is formed by the transfer method, the light transmittance of the metal back layer is hardly increased even when the degree of adhesion between the metal back layer and the phosphor layer is improved. Therefore, the reflectivity is resistant to degradation.

To prevent the phosphor layer from being revealed by pinholes or to prevent brightness from being degraded by the lowering of reflectivity, it is necessary to suppress the light transmittance of the metal back layer to 40% or less, and more preferably 10% or less. When the metal back layer is formed by the transfer method, the metal back layer, which has a very low light transmittance of 10% or below, namely high reflectivity, can be obtained even when the degree of adhesion is enhanced to 30% or more.

Meanwhile, in the metal back layer formed by the lacquer method or the emulsion method, the degree of adhesion between the metal back layer and the phosphor layer becomes high so that pinholes increase sharply in the metal back layer, reflectivity is degraded, and brightness is lowered as a result. And, the pinholes can be decreased by increasing the metal back layer thickness, but the degree of adhesion lowers and brightness is deteriorated. Therefore, it is seen that the metal back layer having relatively good reflectivity can be formed when the degree of adhesion is 30 to 70% by the lacquer method or the emulsion method, but it is hard to obtain a metal back layer having high reflectivity because of a very high degree of adhesion of 70% or more and a very low light transmittance of 10% or less.

Besides, the relationship between the presence or not of an undercoat layer and an overcoat layer for the metal back layer and the deterioration of brightness of the phosphor layer was examined by conducting the following experiments.

Specifically, in the process of forming the aluminum metal back layer using a transfer film, before the transfer film was disposed, the undercoat layer of silica was formed on a blue phosphor layer (ZnS:Ag, Al) in a single color on the entire surface by a method for applying a colloidal silica solution, or an overcoat layer of silica was similarly formed on a metal back layer undergone heating (baking). Thus, phosphor screens with metal back (e) to (h) having the structures shown in Table 2 were formed.

Figure 5:
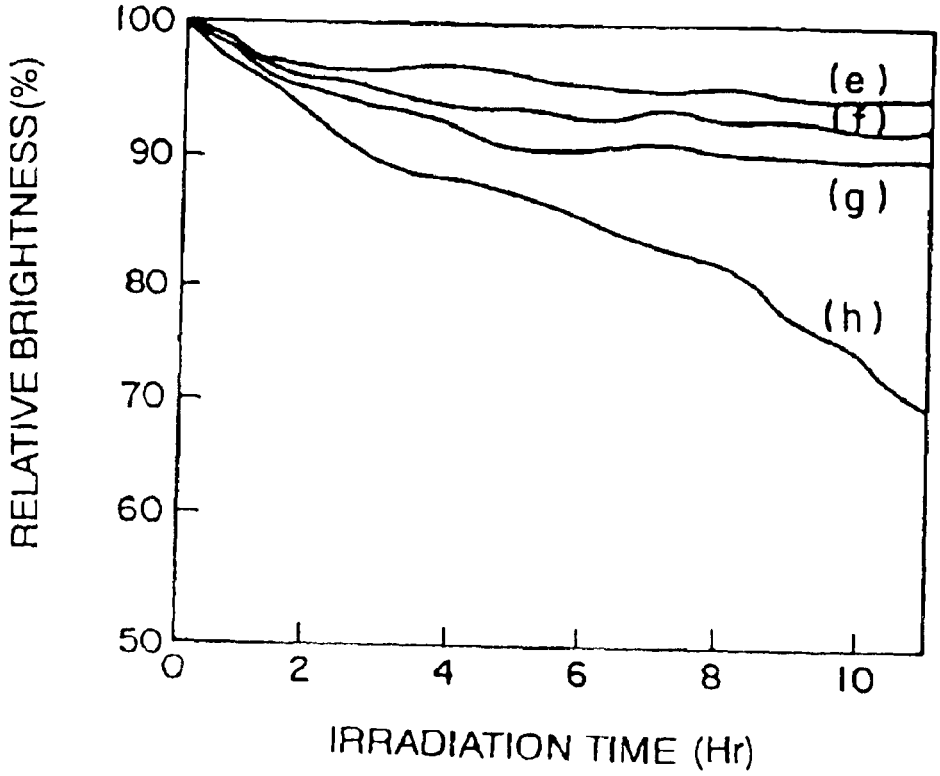
FIG. 5 is a graph showing brightness deterioration characteristics of a phosphor screen with metal back having an undercoat layer and/or an overcoat layer formed on a metal back layer.

Then, these phosphor screens with metal back were measured for center brightness with an acceleration voltage of 10 kV, a current density of 0.25 $\mu A/mm^2$ and an overall raster signal. And a relationship between an electron beam irradiation time and a brightness retention rate (relative brightness) after the irradiation was determined. The measured results are shown in Table 2 and FIG. 5.

TABLE 2

| | (e) | (f) | (g) | (h) |
|---|---|---|---|---|
| Undercoat layer | Yes | Yes | No | No |
| Overcoat layer | Yes | No | Yes | No |
| Brightness deterioration rate | −6% | −8% | −10% | −27% |

It is seen from the above results that the brightness deterioration characteristics can be improved by disposing the undercoat layer between the metal back layer and the phosphor layer or disposing the overcoat layer on the metal back layer, and the brightness deterioration can be suppressed remarkably by disposing both the layers. Reasons for that are considered that the undercoat layer formed between the phosphor layer and the metal back layer serves to fill the gaps between the phosphor particles, so that the degree of adhesion between the metal back layer and the phosphor layer is increased, and the deterioration of brightness is suppressed as a result. And, it is considered that the overcoat layer formed on the metal back layer serves as intervention and the metal back layer is pushed to the phosphor layer, so that the degree of adhesion is increased, and the deterioration of brightness is improved.

As a material configuring the undercoat layer and the overcoat layer which are the intervening layers, inorganic compound-based particles such as aluminum phosphate, $SiO_2$, $Al_2O_3$, $TiO_2$ or the like can be used. These intervening layers can be formed by applying colloidal silica, water glass, a phosphoric acid-based adhesive agent a coupling agent or the like.

Preferable embodiments of the present invention will be described. It is to be understood that the present invention is not limited to the following embodiments.

Figure 6:
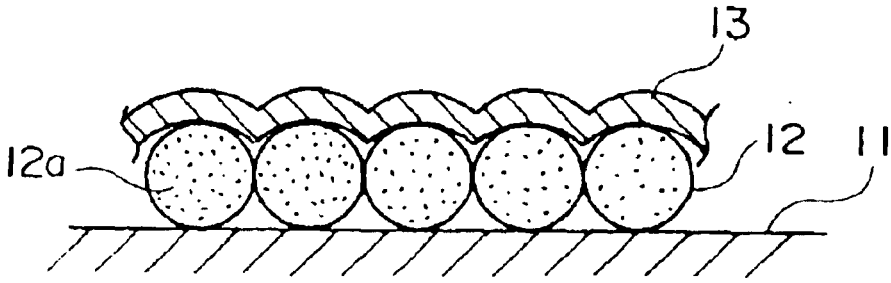
FIG. 6 is an enlarged sectional diagram showing an example of the phosphor screen with metal back according to the present invention.

FIG. 6 is a sectional diagram showing one embodiment of the phosphor screen with metal back according to the present invention. This phosphor screen with metal back forms a part of the FED, and a face plate having the phosphor screen with metal back and a rear plate which has many field emission type or surface conductance type electron-emitting elements formed on a substrate are disposed to oppose to each other with a prescribed gap between them, and the interior is sealed to become vacuum so to configure the image display device.

In the figure, reference numeral 11 denotes a glass substrate, a layer (phosphor layer) 12 formed of phosphor layer particles 12*a* is formed on the internal surface of the glass substrate 11, and a metal back layer 13 of aluminum (Al) or the like is formed on it. The degree of adhesion of the metal back layer 13 to the phosphor layer 12 is 30% or more, and preferably 70% or more, by calculating in a ratio of the area of the metal back layer 13 in contact with the phosphor layer 12 to the entire surface area. And, the metal back layer 13 has a thickness of 5 to 100 nm and light transmittance of 10% or less.

The phosphor screen with metal back has a very high degree of adhesion between the metal back layer 13 and the phosphor layer 12. Therefore, electric charges generated in the phosphor layer 12 by the electron beam irradiation tends to escape outside via the metal back layer 13 and hardly accumulate on the phosphor layer 12. Thus, the deterioration (film deterioration) of emission brightness of the phosphor layer hardly occurs. And, the metal back layer 13 has low light transmittance of 10% or less and high reflectivity, so that high brightness can be achieved.

This phosphor screen with metal back can be formed by the transfer method using a transfer film. Specifically, the transfer film which is formed by sequentially superposing a parting agent layer, a metal film and an adhesive agent layer on a base film is disposed on the phosphor layer formed on a glass substrate in such a way that the adhesive agent layer comes into contact with the phosphor layer. And, the rubber roller for contact bonding under heating is used to make pressure processing. The rubber configuring the pressure portion has hardness of 20 to 100 degrees, the roller is heated to 40 to 250° C., and a pressing force is adjusted to about 1 to 100 kg/cm$^2$ to perform the processing. Then, the base film is peeled, the phosphor screen having the metal film and the like transferred is heated and baked at a temperature of about 450° C., and residual organic contents are removed. Through the above-described process, a metal back layer having a high degree of adhesion with the phosphor layer is completed.

Next, specific examples having the present invention applied to the FED will be described.

EXAMPLE 1

First, a red phosphor ($Y_2O_3S$ based; average particle diameter of about 4 $\mu$m), a green phosphor (ZnS:Cu, Al; average particle diameter of about 4 $\mu$m) and a blue phosphor (ZnS:Ag, Al; average particle diameter of about 4 $\mu$m) were applied onto a glass substrate by the slurry method and dried. Patterning was made by a photolithography method to form a phosphor layer. A 1% solution of water glass was applied to the phosphor layer and dried to form a precoat layer (undercoat layer).

Then, a transfer film, which was formed by sequentially superposing a parting agent layer, an aluminum film (film thickness of 50 nm) and an adhesive agent layer on a base film (e.g., a polyester resin film having a thickness of 20 $\mu$m), was disposed on the above-described phosphor layer, and heat transfer was performed using the rubber roller (rubber hardness of 70 degrees, surface temperature of 200° C.) under a pressure force of 500 kg/cm$^2$. Subsequently, the base film was peeled, and organic contents were removed by heating and baking at a temperature of 450° C. Thus, a face plate, which had the phosphor screen with metal back formed on the internal surface of the glass substrate, was completed. The metal back layer had a film thickness of 70 nm, and a degree of adhesion between the metal back layer and the phosphor layer was about 70% when calculated from an SEM photograph.

Figure 7:
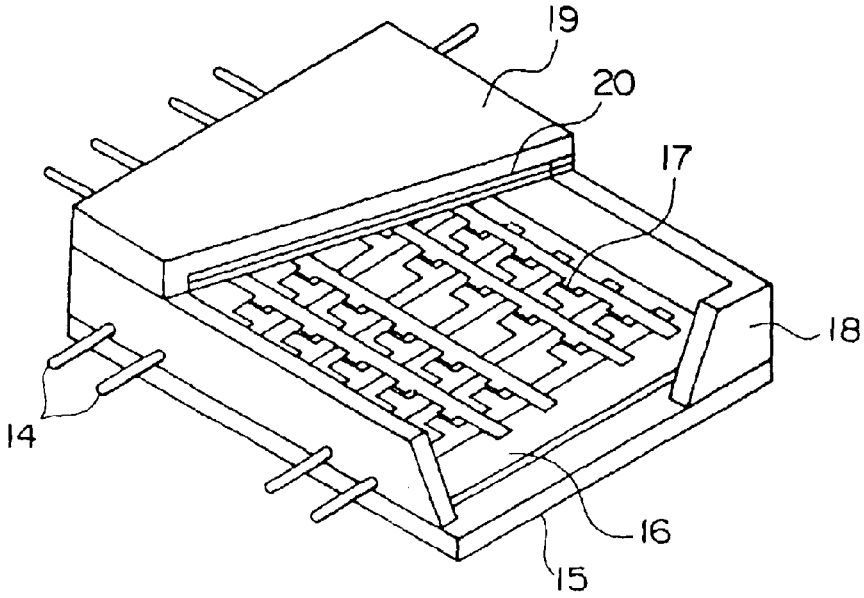
FIG. 7 is a perspective diagram schematically showing the structure of a color FED having the phosphor screen with metal back fabricated in an example of the present invention.
Figure 8:
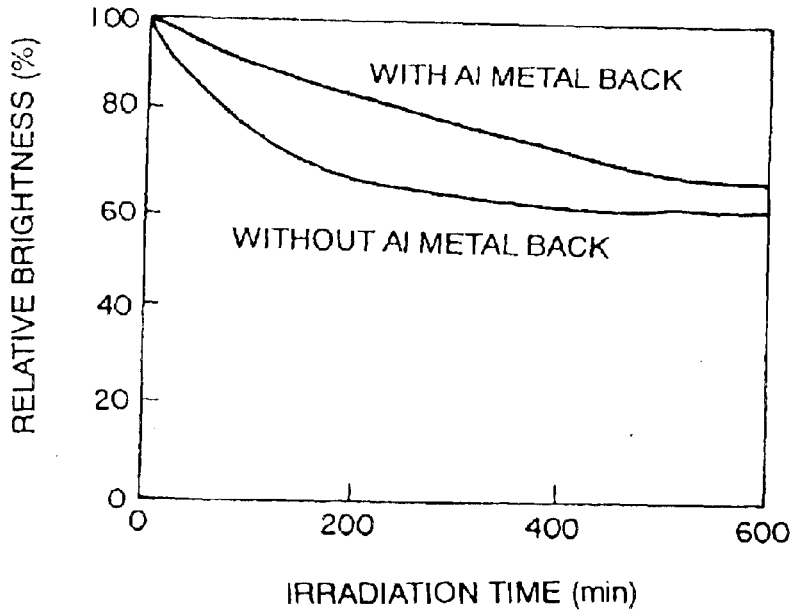
FIG. 8 is a graph showing a difference in brightness deterioration characteristics depending on the presence or not of an aluminum metal back layer.

Then, an electron emission source, which had many surface conduction type electron-emitting elements formed in matrix on the substrate, was fixed to the rear plate. The rear plate was sealed to the face plate by frit glass through a support frame between them. Then, necessary processing such as evacuation and sealing was performed to complete a 10-inch color FED having the structure as shown in FIG. 7. In the figure, reference numeral 14 denotes a high voltage terminal, 15 denotes the rear plate, 16 denotes the substrate, 17 denotes the surface conduction type electron-emitting elements, 18 denotes the support frame, 19 denotes the face plate and 20 denotes the phosphor screen with metal back.

EXAMPLE 2

The same procedure as in Example 1 was performed except that the metal back layer was directly transferred without forming the undercoat layer on the phosphor layer to form the phosphor screen with metal back so to complete the FED display device. The metal back layer had a thickness of 70 nm, and the degree of adhesion between the metal back layer and the phosphor layer was about 40%.

Then, the FEDs obtained in Example 1 and Example 2 were measured for the brightness deterioration characteristics of the phosphor layer at an acceleration voltage of 10 kV and a current density of 0.25 $\mu$A/mm$^2$ by the raster method. It was found that the brightness retention rate (relative brightness) after 10-hour irradiation was 95% or more in Example 1, and the deterioration of brightness was remarkably suppressed. In Example 2, the blue phosphor layer had a brightness retention rate of about 78%, indicating that a satisfactory effect of improving the brightness deterioration was obtained. Besides, it was found in both of the examples that the metal back layer had the light transmittance of about 5%, and pinholes were not many, so that the reflectivity was good.

EXAMPLE 3

A metal back layer (aluminum film) was formed by the lacquer method on the phosphor layer which was formed in the same way as in Example 1. To allow easy penetration of the metal back layer into the gaps of the particles of the phosphor layer, a lacquer film was adjusted to have a thickness of half (about 0.5 $\mu$m) of the normal thickness, and an aluminum film having a thickness of 100 nm was formed on it by vacuum deposition. The degree of adhesion of the obtained metal back layer with the phosphor layer was 70%.

Then, the face plate, which had the phosphor screen with metal back formed on the internal surface, was used to complete the FED. And, the FED was measured for the brightness deterioration characteristics of the phosphor layer at an acceleration voltage of 10 kV and a current density of 0.25 $\mu$A/mm$^2$ by the raster method. It was found that the brightness retention rate (relative brightness) was 85% after 10-hour irradiation. Thus, a satisfactory effect of improving the brightness deterioration was found. But, the metal back layer had high light transmittance of about 45%, indicating that the deterioration of brightness was caused by the deterioration of reflectivity.

As Comparative Example 1, an aluminum film having a thickness of 100 nm was formed by vapor deposition with a lacquer film determined to have the same thickness of 1 $\mu$m as before, and the FED was produced in the same way as in Example 3. In the FED, a degree of adhesion between the metal back layer and the phosphor layer was about 20%. The FED had a brightness retention rate of 60% after 10-hour irradiation, and an effect of improving the brightness deterioration was not satisfactory. The light transmittance of the metal back layer was relatively high to about 30%, and reflectivity was not satisfactory.

EXAMPLES 4 TO 6

Transfer films respectively having polyester resin films with thickness of 5 $\mu$m, 10 $\mu$m, 30 $\mu$m and 50 $\mu$m as a base film were used to transfer and form an aluminum film having a thickness of 70 nm onto the phosphor layer in the same way as in Example 2. The rubber roller for contact bonding under heating had a heating temperature of 200° C.

Then, the face plate which had the phosphor screen with metal back formed on the internal surface was used to complete the FED. And, a degree of adhesion between the metal back layer and the phosphor layer was calculated. These FEDs were measured for the brightness deterioration characteristics of the phosphor layer at an acceleration voltage of 10 kV and a current density of 0.25 $\mu$A/mm$^2$ by the raster method. The measured results are shown in Table 3.

TABLE 3

| | Example 4 | Example 5 | Example 6 | Comparative Example 2 |
|---|---|---|---|---|
| Base film thickness (μm) | 5 | 10 | 30 | 50 |
| Degree of adhesion (%) | 90 | 85 | 70 | 20 |
| Brightness retention rate (%) | 95 | 90 | 88 | 70 |

It is seen from Table 3 that the FEDs obtained in Example 4 to Example 6 have a high degree of adhesion of 30% or more between the metal back layer and the phosphor layer, so that the deterioration of brightness of the phosphor layer by the electron beam irradiation is hardly caused, and they have a satisfactorily high brightness retention rate. Meanwhile, the FED obtained in Comparative Example 2 has a low degree of adhesion of 20% between the metal back layer and the phosphor layer, so that it has a tendency to have the deterioration of brightness of the phosphor layer by the electron beam irradiation, and a brightness retention rate is low.

INDUSTRIAL APPLICABILITY

As described above, the phosphor screen with metal back of the present invention can substantially suppress the deterioration of emission brightness of the phosphor layer by increasing a degree of adhesion between the metal back layer and the phosphor layer. And, the transfer method is adopted to form the phosphor screen with metal back having a high degree of adhesion, so that the metal back layer having a very low light transmittance, namely high reflectivity, can be obtained. And, the image display device which can make display with high brightness and excellent quality can be obtained.

What is claimed is:

1. A phosphor screen with metal back, comprising a phosphor layer formed on the internal surface of a translucent substrate and a metal back layer formed on the phosphor layer, wherein a degree of adhesion of the metal back layer to the phosphor layer is 30% or more in a ratio of areas of the layers contacted with each other.

2. The phosphor screen with metal back as set forth in claim 1, wherein the metal back layer has a thickness of 5 to 100 nm and also has the light transmittance of 10% or less.

3. The phosphor screen with metal back as set forth in claim 2, wherein the metal back layer has an intervening layer containing inorganic particles on at least one main surface thereof.

4. The phosphor screen with metal back as set forth in claim 1, wherein the metal back layer has an intervening layer containing inorganic particles on at least one main surface thereof.

5. An image display device, having a face plate, wherein the phosphor screen with metal back as set forth in claim 1 is disposed on the face plate.

6. The image display device as set forth in claim 5, comprising a rear plate being disposed opposite to the face plate and having many electron-emitting elements on the rear plate.

7. A method for forming a phosphor screen with metal back, comprising:

preparing a translucent substrate;

forming a phosphor layer on the internal surface of the translucent substrate;

forming a metal back layer, the forming of the metal back layer including disposing a transfer film having a base film and at least a parting agent layer and a metal layer stacked on the base film so that the metal layer is contacted to the phosphor layer with an adhesive agent layer between them, transferring the metal layer by pressing and bonding, and peeling the base film; and heating the substrate which has the metal back layer formed on the phosphor layer, wherein the metal layer is transferred in such a way that a degree of adhesion between the phosphor layer and the metal layer is 30% or more in a ratio of areas of both the layers contacted.

8. The method for forming a phosphor screen with metal back as set forth in claim 7, further comprising:

forming an intervening layer containing inorganic particles on the phosphor layer before disposing the transfer film on the phosphor layer in the step of forming the metal back layer.

9. The method for forming a phosphor screen with metal back as set forth in claim 8, further comprising:

forming an intervening layer containing inorganic particles on the metal back layer formed on the phosphor layer after heating the substrate.

10. The method for forming a phosphor screen with metal back as set forth in claim 7, further comprising:

forming an intervening layer containing inorganic particles on the metal back layer formed on the phosphor layer after heating the substrate.

* * * * *